US007036183B2

(12) United States Patent
Gammack et al.

(10) Patent No.: US 7,036,183 B2
(45) Date of Patent: May 2, 2006

(54) HOSE AND WAND ASSEMBLY

(75) Inventors: Peter David Gammack, Bath (GB); Jonathan Paul Taylor, Stroud (GB); Matthew James Roger Allard, Bath (GB)

(73) Assignee: Dyson Limited, Wiltshire (GB)

( * ) Notice: Subject to any disclaimer, the term of this patent is extended or adjusted under 35 U.S.C. 154(b) by 376 days.

(21) Appl. No.: 10/220,039

(22) PCT Filed: Feb. 7, 2001

(86) PCT No.: PCT/GB01/00498

§ 371 (c)(1),
(2), (4) Date: Oct. 28, 2002

(87) PCT Pub. No.: WO01/65989

PCT Pub. Date: Sep. 13, 2001

(65) Prior Publication Data

US 2003/0101535 A1 Jun. 5, 2003

(30) Foreign Application Priority Data

Mar. 3, 2000 (GB) ..... 0005046

(51) Int. Cl.
*A47L 5/28* (2006.01)
*A47L 5/32* (2006.01)

(52) U.S. Cl. ..... 15/335; 15/334

(58) Field of Classification Search ..... 15/331, 15/334, 335, 351, 328, 414; 285/7
See application file for complete search history.

(56) References Cited

U.S. PATENT DOCUMENTS

| | | | | |
|---|---|---|---|---|
| 2,867,833 | A | 1/1959 | Duff | |
| 3,879,797 | A * | 4/1975 | Principe et al. | 15/334 |
| 4,393,536 | A | 7/1983 | Tapp | |
| 4,519,113 | A * | 5/1985 | Hipple | 15/335 |
| 4,571,772 | A * | 2/1986 | Dyson | 15/335 |
| 4,573,236 | A * | 3/1986 | Dyson | 15/333 |
| 5,797,162 | A * | 8/1998 | Vystrcil et al. | 15/323 |
| 5,815,883 | A * | 10/1998 | Stein et al. | 15/327.1 |
| 5,836,047 | A | 11/1998 | Lee et al. | |
| 6,363,571 | B1 * | 4/2002 | Block et al. | 15/335 |
| 6,526,623 | B1 * | 3/2003 | Dyson | 15/334 |
| 6,572,078 | B1 * | 6/2003 | Thomson et al. | 251/162 |

FOREIGN PATENT DOCUMENTS

EP 0 134 654 3/1985

(Continued)

*Primary Examiner*—Terrence R. Till
(74) *Attorney, Agent, or Firm*—Morrison & Foerster LLP

(57) ABSTRACT

A vacuum cleaner (100) comprises a main body (3), separating apparatus, a flexible hose (20) having one end for coupling to an input of the separating apparatus and the other end terminating in a connecting part (40), a rigid pipe (9, 10) being selectively connectable to the main body (3) (see FIG. 2A) so as to provide a handle for the cleaner when connected to the main body (3), or a wand when released from the main body (3). The pipe (9) has an opening at each of first and second ends (16, 17) and a gripping portion (11) at the first end (17) for allowing a user to grasp the pipe (9). The hose connecting part (40) is connectable to the opening at either end (16, 17) of the pipe (9). Thus, the pipe (9) can be more conveniently used during a cylinder mode of cleaning.

11 Claims, 9 Drawing Sheets

FOREIGN PATENT DOCUMENTS

| | | |
|---|---|---|
| EP | 0 180 367 | 5/1986 |
| EP | 0 887 040 | 12/1998 |
| GB | 452111 | 8/1936 |
| WO | WO 99/30605 | 6/1999 |

* cited by examiner

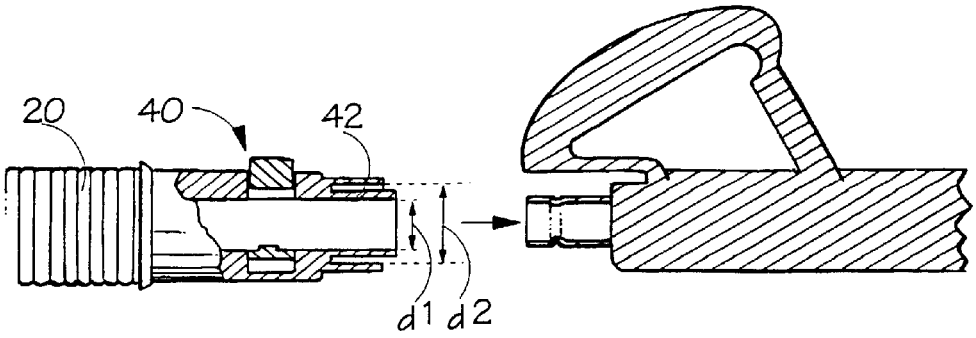
FIG.9B.
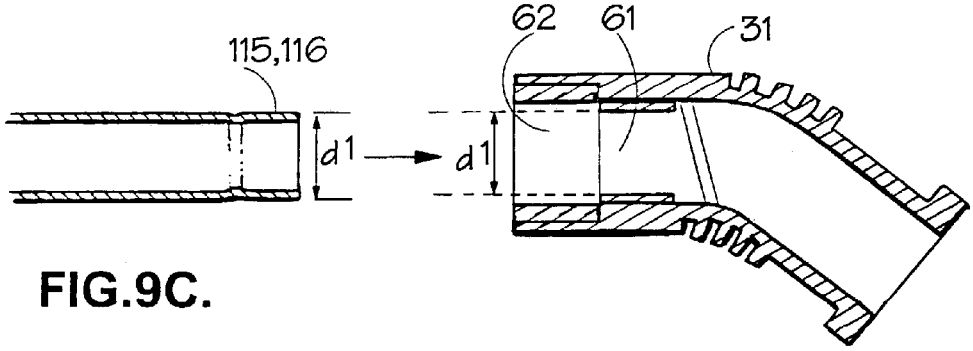
FIG.9C.
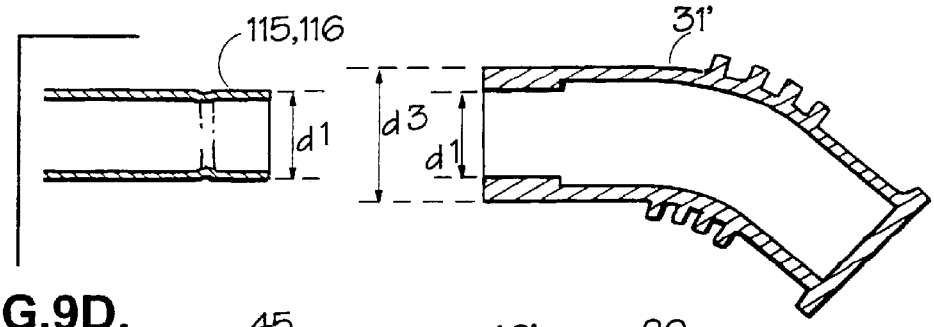
FIG.9D.
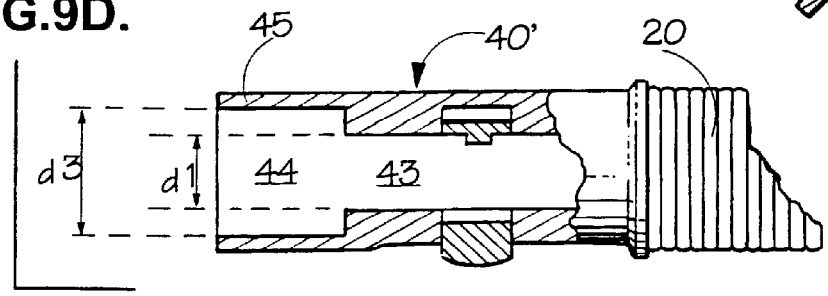

HOSE AND WAND ASSEMBLY

FIELD OF THE INVENTION

The present invention relates to a vacuum cleaner with a hose and wand assembly.

BACKGROUND OF THE INVENTION

An upright vacuum cleaner generally comprises a cleaner head rotatably mounted to the lower end of the main body of the vacuum cleaner. The cleaner head has a downwardly directed dirty air inlet through which dirty air is sucked into dust separation apparatus. The dust separation apparatus usually takes the form of a bag or a cyclonic separator. This type of vacuum cleaner is often convertible between an upright mode of operation and a cylinder mode of operation.

In the upright mode, the vacuum cleaner is moved over the surface to be cleaned so that the dirty air enters the dust separation apparatus via the dirty air inlet in the cleaner head whilst the main body is inclined rearwardly. The vacuum cleaner comprises an upwardly extending handle which the user can use to move the vacuum cleaner over the surface to be cleaned.

In the cylinder mode, the main body is put into an upright position and a wand, which is connected to the vacuum cleaner by a length of flexible hose, is used to introduce dirty air to the dust separation apparatus.

One known type of upright vacuum cleaner described in EP 134654 comprises a wand having a generally rigid pipe portion and a generally flexible hose portion. The hose portion is connected at one end to the main body of the vacuum cleaner and at the other end to the rigid pipe. The rigid pipe is selectively connectable to the main body of the vacuum cleaner so as to form a handle for the cleaner in an upright mode, or a wand in a cylinder mode. This arrangement avoids the need to store an additional pipe on the cleaner for use as a wand, since the pipe serves as both a handle for the cleaner and a wand.

In the upright mode, the rigid pipe portion is slid telescopically inside the hose portion and secured to the back of the main body of the vacuum cleaner so that the rigid pipe portion extends upwardly from the main body to form a handle. The user can then grasp the handle to move the cleaner head over the surface to be cleaned. In the cylinder mode, the rigid pipe portion is connected to the main body of the vacuum cleaner via the flexible hose. The pipe portion is released from the main body of the cleaner to allow a user to grip the rigid pipe portion and to manoeuvre it freely with respect to the main body in the manner of a wand. Tools such as a nozzle or brush are attached to the distal end of the rigid pipe portion, which forms the dirty air inlet of the vacuum cleaner for cleaning those parts of a room which cannot be reached with the normal cleaner head, such as confined spaces, furnishings and other above-floor cleaning.

While the wand and flexible hose allow a user freedom in their cleaning, the rigid pipe can sometimes be difficult to use. The handle portion of the pipe, which a user grasps to manoeuvre the cleaner during the upright mode of cleaning, is located remote from the user and can sometimes cause an obstruction when a user is attempting to reach a confined space. Also, the position of the handle at the remote end of the pipe results in a significant portion of the weight being at this end of the wand, which can also make the wand difficult to use.

SUMMARY OF THE INVENTION

U.S. Pat. No. 2,867,833 shows a vacuum cleaner in which a pipe serves the two functions of being part of a handle for the machine, when the pipe is stowed in the cleaner body, and an extension wand for use in cleaning when the pipe is removed from the cleaner body.

The present invention seeks to allow a vacuum cleaner to be more convenient to use.

A first aspect of this provides a hose and wand assembly for a vacuum cleaner, of the type which includes a main body having an inlet to a separating apparatus. The hose and wand assembly includes a flexible hose having one end for coupling to the inlet of the separating apparatus and the other end terminating in a connecting part and a rigid pipe that is selectively connectable to the main body so as either to provide a handle for the cleaner when it is connected to the main body or to act as a wand when released from the main body, the pipe having an opening at each of first and second ends and having a gripping portion at the first end for allowing a user to grasp the pipe, the hose connecting part being connectable to the opening end of the pipe.

This has an advantage that the rigid pipe can be more conveniently used during a cylinder mode of cleaning. By connecting the flexible hose to the first end of the pipe, adjacent the gripping portion, a user can more easily manoeuvre the pipe, reaching into confined spaces without the hindrance of the gripping portion at the remote end of the pipe. Also, since the gripping portion is at the end of the pipe near to the user, the user can use the gripping portion to manoeuvre the pipe. Furthermore, the position of the gripping portion near to the user reduces the weight at the distal end of the pipe, which also improves manoeuvrability and comfort for the user.

The gripping portion is a part of the pipe which is intended to be used as a handle. It can be a part of the pipe which is shaped or has surface features such as ridges which allows a user to grip the pipe or it can be a separate part which extends from the pipe.

Preferably the openings at the first and second ends of the pipe are of the same shape. Alternatively, the openings at the first and second ends of the pipe are of different shape, and the cleaner further comprises an adapter having an inlet which is connectable to the first end of the pipe and an outlet which fits the hose connecting part.

Preferably the vacuum cleaner further comprises an accessory tool having an outlet which is connectable to the openings at the first and second ends of the pipe. More preferably, the outlet of the accessory tool is also connectable to the hose connecting part. This can be achieved by providing the accessory tool with an outlet which has sleeves of two different diameters.

Another aspect of the invention provides a handle for a vacuum cleaner comprising a rigid pipe which is selectively connectable to a main body of the cleaner so as to provide a handle for the cleaner when connected to the main body, or a wand when released from the main body, the pipe having an opening at each of first and second ends and having a gripping portion at the first end for allowing a user to grasp the pipe, the openings being of the same shape so that either opening can connect to a connecting part of a flexible hose for connecting to a separating apparatus of the cleaner.

A further aspect of the invention provides a vacuum cleaner incorporating a hose and wand assembly or a handle of the above type.

BRIEF DESCRIPTION OF THE DRAWINGS

Embodiments of the invention will now be described with reference to the accompanying drawings, in which:

FIGS. 9A to 9D show alternative arrangements to that shown in FIGS. 3A to 8B.

DETAILED DESCRIPTION OF THE INVENTION

Figure 1:
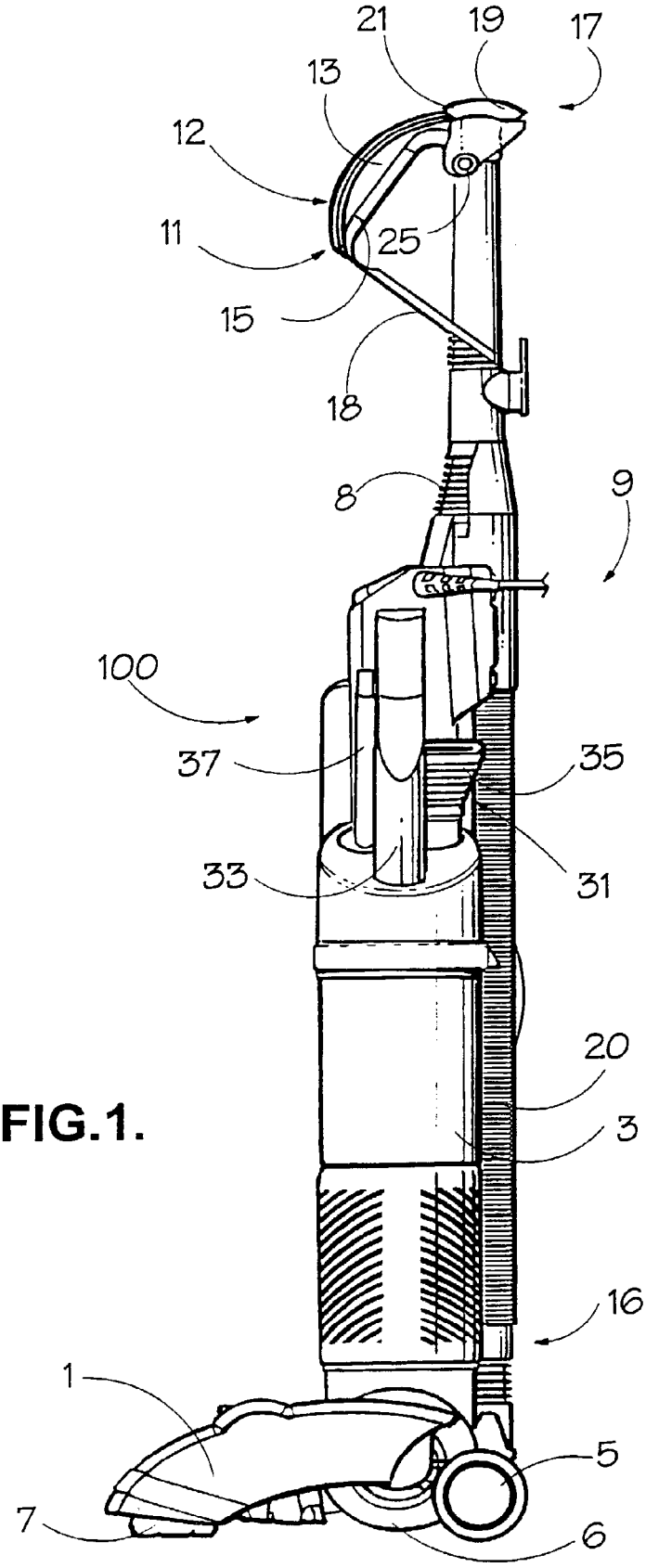
FIG. 1 shows an upright type of vacuum cleaner.

The vacuum cleaner 100 comprises a cleaner head 1 rotatably mounted to the lower end of the main body 3 of the vacuum cleaner 100. The main body 3 houses dust separating apparatus (not shown). This can take the form of one or more cyclonic separating devices, a dust bag or some other form of separating apparatus. A pair of wheels 5 are also mounted at the lower end of the main body 3 via a motor casing 6 from which the cleaner head 1 extends in a forward direction.

The cleaner head 1 has a dirty air inlet 7 located at its forward end and facing downwardly so that, in use in an upright mode, the dirty air inlet 7 contacts a surface to be cleaned and dirty air enters the cleaner head 1 via the dirty air inlet 7 before being conducted to the dust separating apparatus. A wand 9 is releasably attached to the rear of the main body 3 of the vacuum cleaner 100.

Figure 2B:
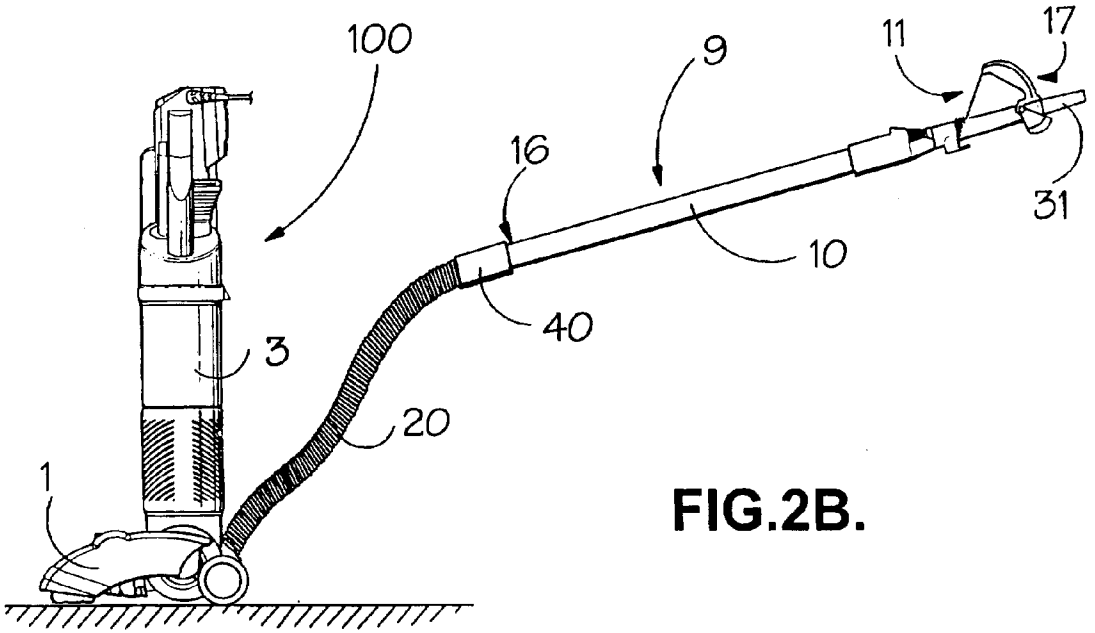
FIG. 2B shows the vacuum cleaner of FIG. 1 used in a cylinder mode of operation.
Figure 2A:
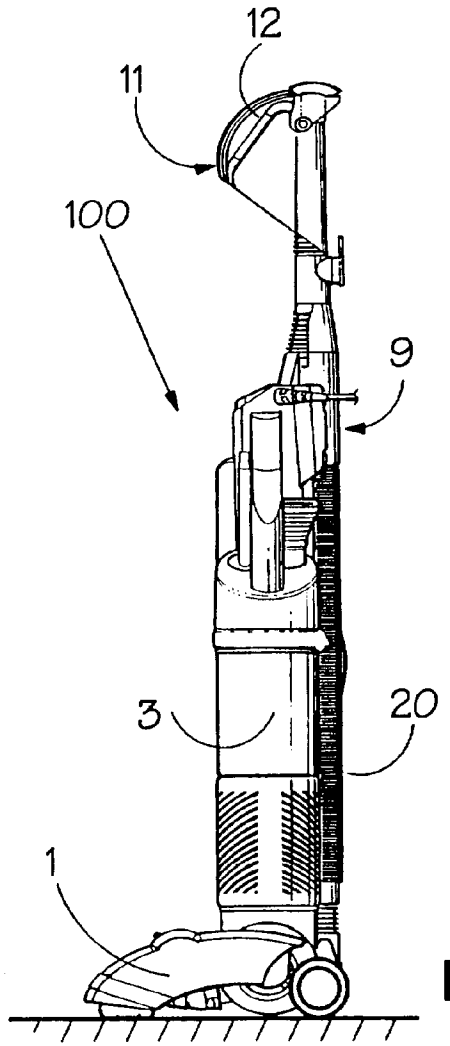
FIG. 2A shows the vacuum cleaner of FIG. 1 used in an upright mode of operation.

In the upright cleaning mode, as shown in FIG. 2A, the wand 9 is clipped to the main body 3 of the vacuum cleaner 100 so that the wand 9 extends upwardly from the main body 3. The gripping portion 12 of the handle 11 is grasped by the user and the main body 3 of the vacuum cleaner 100 is tilted rearwardly towards the user and away from the cleaner head 1.

In the cylinder cleaning mode, as shown in FIG. 2B, the wand 9 is detached from the main body 3 of the vacuum cleaner 100 and extended for use, the distal end 17 of the wand 9 becoming the active dirty air inlet. A valve (not shown) is provided for shutting off the dirty air inlet in the cleaner head 1 when the cleaner is used in the cylinder mode. The valve is responsive to the position of the wand 9 with respect to the main body 3 of the cleaner. When the wand 9 is attached to the main body 3 and retracted inside the hose 20, for an upright mode of operation, the valve allows dirty air to flow from the cleaner head 1. When the wand 9 is detached from the main body 3 the valve allows dirty air to flow from the pipe 10. A suitable valve mechanism is described in U.S. Re.32,257.

The wand 9 comprises a rigid pipe portion 10 and a flexible hose portion 20. The proximal end 16 of the rigid pipe portion 10 is slidably and releasably connected to one end of the flexible hose portion to allow telescopic sliding of the pipe portion 10 within the hose portion 20. The proximal end 16 of the flexible hose portion is fixedly connected to the lower end of the main body 3 of the vacuum cleaner. The pipe portion 10 and hose portion 20 together provide an air flow path into the dust separation apparatus when the vacuum cleaner is used in a cylinder mode. In this embodiment, the pipe portion 10 of the wand 9 consists of a straight, hollow tube having no internal bends. This reduces the risk of blockage and also allows the user to look down the pipe 10 in case of a blockage and to remove the blockage by introducing an elongate tool into the pipe portion from one end. However, as described further below, the pipe 10 does not have to be straight along its entire length.

The pipe portion 10 extends upwardly from the main body 3 of the vacuum cleaner to form a handle 11 when the vacuum cleaner 100 is to be used in its upright mode. The handle 11 comprises a gripping portion 12 which extends forwardly and downwardly from the distal end of the pipe portion 10 at an acute angle to longitudinal axis of the pipe portion 10. The gripping portion 12 comprises an outer portion 13 having a curved outer surface and an inner portion 15. The gripping portion 12 is shaped so as to be comfortable for a user to hold. A lower portion 18 of the handle 11 extends from the forward end of the gripping portion 12 downwardly and rearwardly to attach the gripping portion 12 of the handle 11 to the pipe portion 10 at a point approximately midway between the distal end of the pipe portion 10 and the top of the main body 3 of the vacuum cleaner 100. The lower portion 18 braces the gripping portion and provides strength and stability thereto. As an alternative to a pipe 10 which is straight along its entire length, the pipe 10 can have a bend close to its distal end, the distal portion of the pipe 10 serving as a handle.

Preferably, a cap 19 is pivotably attached to the distal end 17 of the pipe portion 10 at a pivot point 25 on either side of the pipe portion 10. The pivot points 25 are located beneath the point at which the gripping portion 12 is attached to the pipe portion 10. The cap 19 comprises an outer curved surface 21 remote from the pivot points 25 and two side walls 20. The side walls 20 each extend downwardly from the curved surface 21 to the respective pivot point 25 on either side of the rigid pipe portion 10. The outer curved surface 21 is longer than the end of the pipe portion 10. Biasing means (not shown) such as a spring or resilient strip, urge the cap 19 into the closed position. The cap 19, in its closed position, covers the remote end of the wand 9 to prevent objects dropping down into the wand 9 and also to reduce the risk of injury through improper use.

In the cylinder mode, the wand 9 is released from the main body 3 of the vacuum cleaner 100. The cap 19 is tilted rearwardly away from the open, distal end 27 of the wand 9 to expose the dirty air inlet. Accessory tools 31 can then be attached to the wand 9. The accessory tools 31 can include a nozzle 33, a circular brush 35 and a crevice tool 37 and a grooming tool (not shown) for use with absorbent powder on carpets. Attaching a tool, as required, to the open end 27 of the wand 9 forms the dirty air inlet of the vacuum cleaner 100 and retains the cap 19 in the open position.

The accessory tools 31 can be stored on top of the dust separating apparatus of the vacuum cleaner 100 so that they are easily accessible. Alternatively, they can be stored on top of the cleaner head 1. The tools 31 can be stored on corresponding sockets or pegs or held by clips.

FIGS. 3A to 9D show the various ways in which the cleaner 100 can be used in a cylinder mode.

A user can use the cleaner 100 in various ways, depending on the cleaning job that a user has to perform.

Figure 3A:
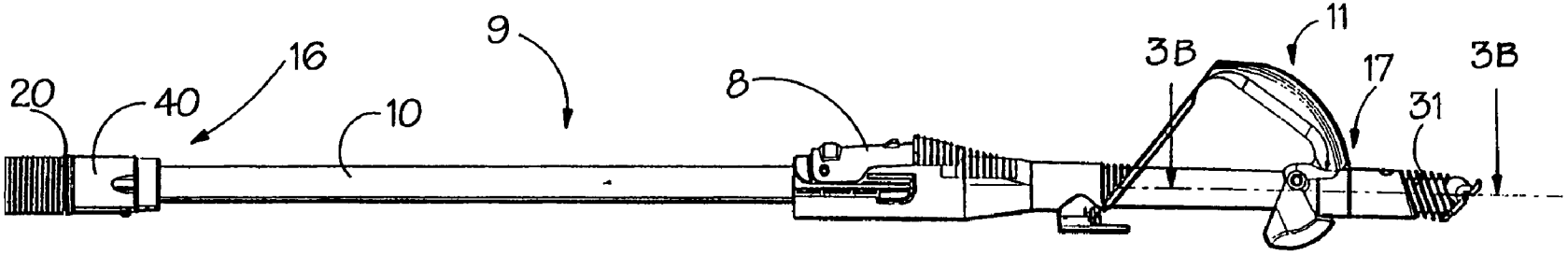
FIGS. 3A and 3B show a first way of using the cleaner of FIG. 1 in a cylinder mode of operation.

For jobs where the user wants to hold a wand and requires some distance between the accessory tool and the user, such as cleaning along the edge of a skirting board without bending down, or in reaching places high in a room, the accessory tool 31 is mounted to one end of the wand 9 and the user holds the other end of the wand 9 to direct the tool. The accessory tool 31 can be mounted to either end 16, 17 of the wand 9. Firstly, FIG. 3A shows a known arrangement. Hose connector 40 is connected to end 16 of the wand 9. A tool 31 is mounted to distal end 17 of the wand 9. Using the cleaner in this manner is quick for the user as the hose connector 40 is already connected to end 16 of pipe 10 when the cleaner is used in an upright mode (FIG. 2A.) The user simply releases wand 9 from the main body 3 of the cleaner using release mechanism 8 and mounts the accessory tool 31 to end 17. However, as previously described, there is a disadvantage that the user needs to hold the wand 9 by the hose connector 40.

Figure 4A:
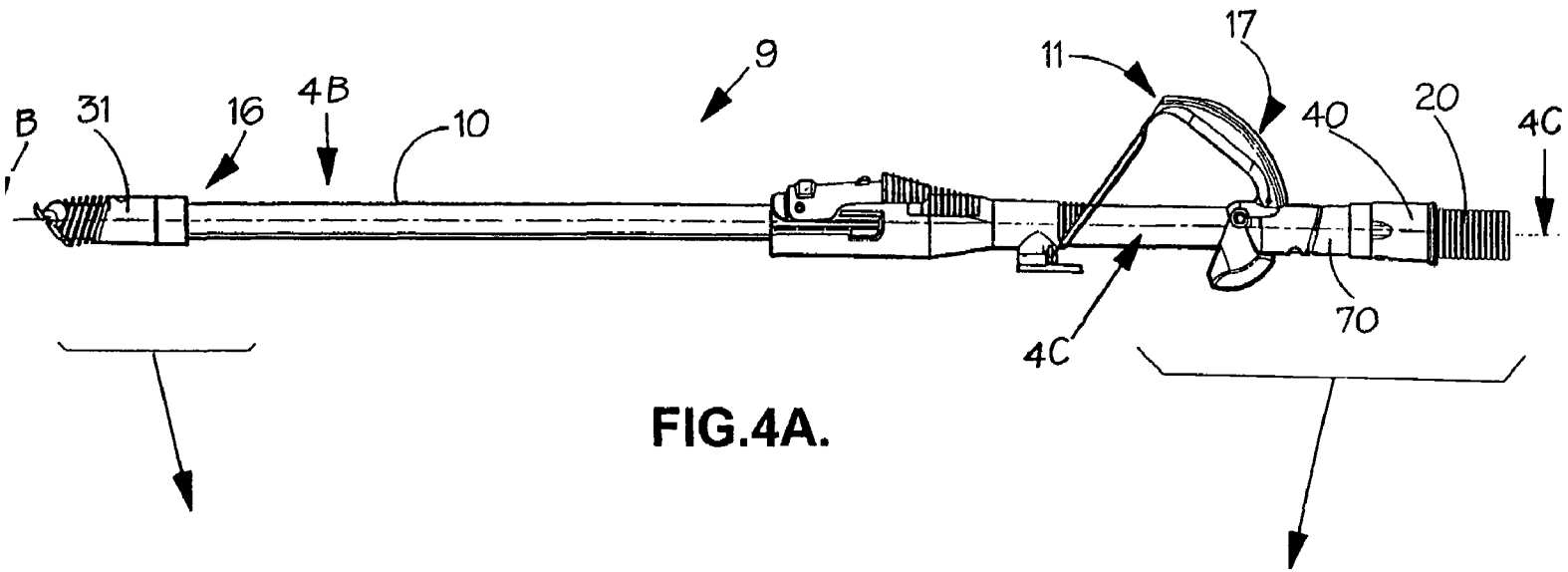
FIGS. 4A–C show a second way of using the cleaner of FIG. 1 in a cylinder mode of operation.

FIG. 4A shows hose connector 40 connected to distal end 17 of the wand 9. A tool 31 is mounted to end 16 of the wand 9. As before, the user releases wand 9 from the main body 3 of the cleaner using release mechanism 8. The hose connector 40 is disconnected from end 16 of the wand 9 and connected to end 17 of the wand 9. An adapter 70 is used to make the connection to end 17. Accessory tool 31 is then mounted to end 16 of the wand 9. With this arrangement, a user benefits from having the handle in a position which is comfortable to use.

Figure 5A:
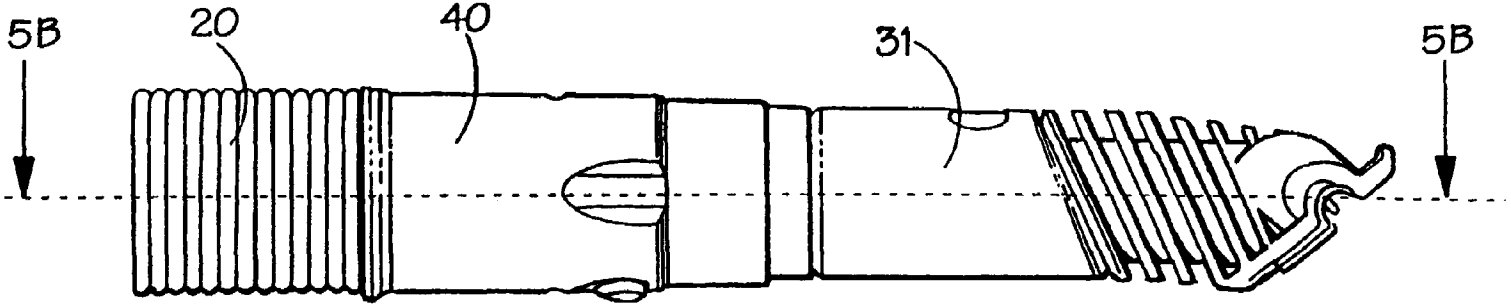
FIGS. 5A and 5B show a third way of using the cleaner of FIG. 1 in a cylinder mode of operation.

For cleaning jobs in confined spaces, where the user wants to hold the accessory tool, such as cleaning the interior of a car or upholstery, it is preferable to connect an accessory tool directly to the end of the hose portion 20. FIG. 5A shows accessory tool 31 connected directly to the hose connector 40. To achieve this, the user releases wand 9 from the main body 3 of the cleaner using release mechanism 8. The hose connector 40 is disconnected from end 16 of the wand 9 and connected to the accessory tool 31.

Figure 6A:
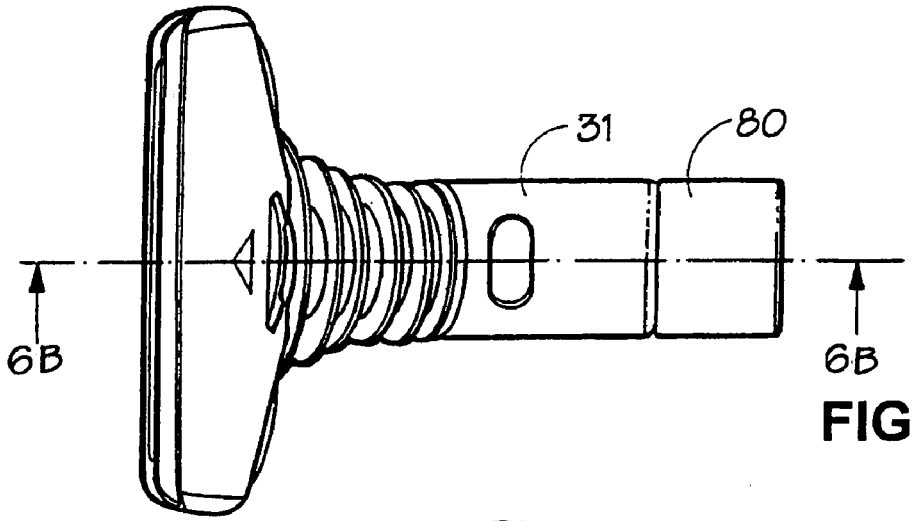
FIGS. 6A and 6B show an accessory tool for use in the arrangements of FIGS. 3A–5B.
Figure 6B:
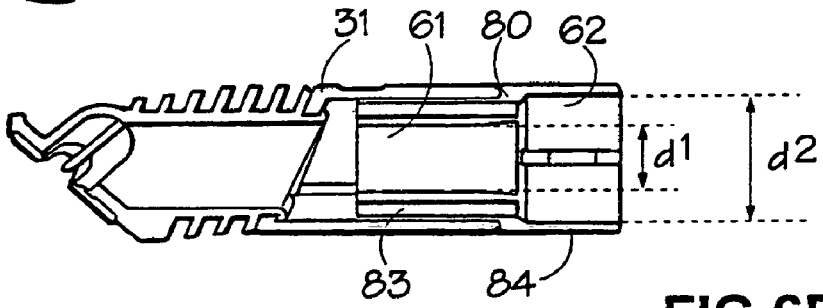

Each accessory tool 31 is capable of fitting on to the hose connector 40 or to either end 16, 17 of the wand 9. This is achieved by providing the accessory tool with an outlet which has sleeves of two diameter diameters. FIGS. 6A and 6B show the accessory tool 31 in more detail. The outlet of the tool 31 has a first portion 61 of diameter d1 and a second portion 62, adjacent the outlet, of a wider diameter d2. The different diameter portions 61, 62 of the outlet can be achieved by moulding the tool with an outlet in this form. It is also possible to modify existing tools, having an outlet of one diameter (d2). FIGS. 6A and 6B show an insert 80 fitted in the outlet of tool 31 providing the two diameter portions 61, 62. FIGS. 7A to 7D show the insert 80 in more detail. It comprises a narrow sleeve 83 which fits within the outlet of an accessory tool 31 and provides the portion 61 of diameter d1 and a wider sleeve 84 which provides portion 62 or wider diameter d2. When the insert 80 is fitted into the outlet of tool 31, lip 86 of the insert abuts the end of the outlet of the tool 31. The insert is preferably fitted in the tool by spin-welding, but other techniques can be used, such as the use of an adhesive. Ribs 81, 82 are provided on the interior surface of insert 80 and serve, in use, to grip the hose connector 40 or ends 16, 17 of the wand 9.

FIGS. 3B, 4B, 4C, 5B show cross-sectional views through the different connection arrangements and show in more detail how the accessory tool 31 and adapter 70 allow these connection arrangements.

Figure 3B:
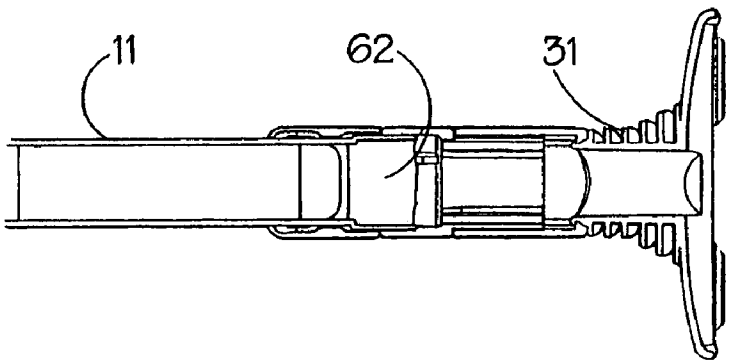

FIG. 3B is a cross-section along A—A of FIG. 3A. End 17 of wand 9 fits within portion 62 (diameter d2) of the tool 31 outlet.

Figure 4B:
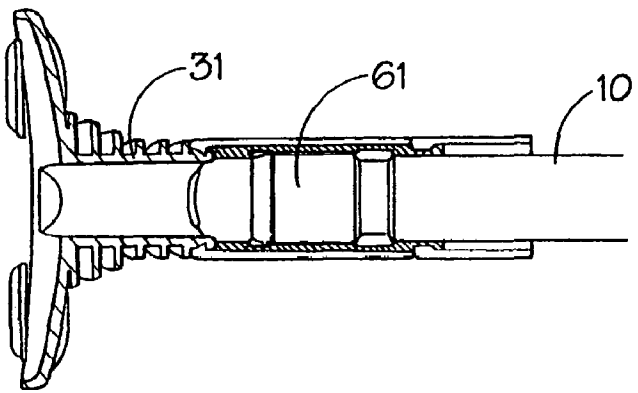
Figure 4C:
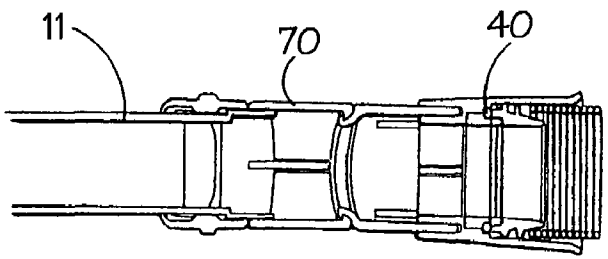

FIGS. 4B and 4C are views of the ends of the cross-section along 4C—4C of FIG. 4A. End 16 of the wand 9 fits within portion 61 (diameter d1) of the outlet of tool 31 while hose connector 40 fits to end 17 of the wand 9 via adapter 70. Adapter 70 provides a female-to-female connection between the hose connector 40 and end 17 of the wand 9. The inlets of adapter 70 are of equal diameter (d2).

Figure 5B:
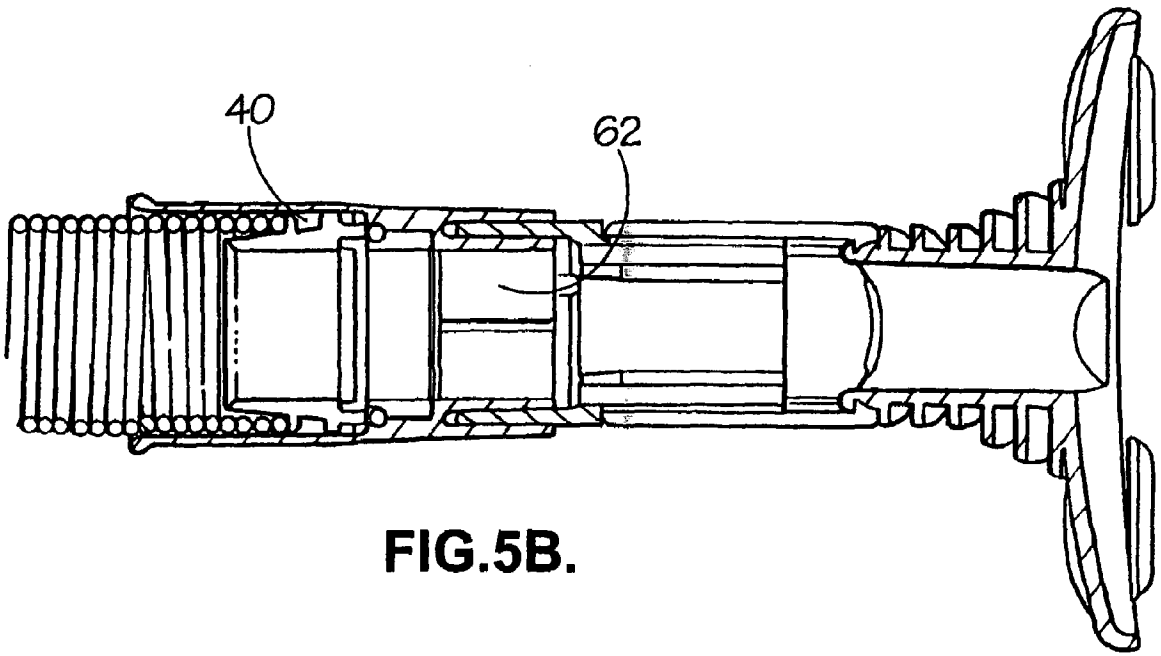

FIG. 5B is a cross-section along 5B—5B of FIG. 5A. Hose connector 40 fits within portion 62 (diameter d2) of the outlet of accessory tool 31.

Figure 8A:
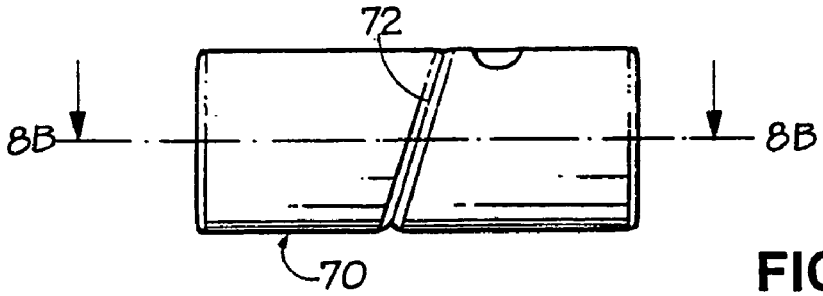
FIGS. 8A and 8B show an adapter for use in the arrangement of FIGS. 4A and 4B.
Figure 8B:
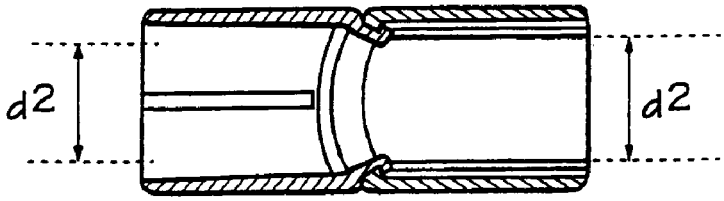
Figures 7A, 7B, 7C, 7D:
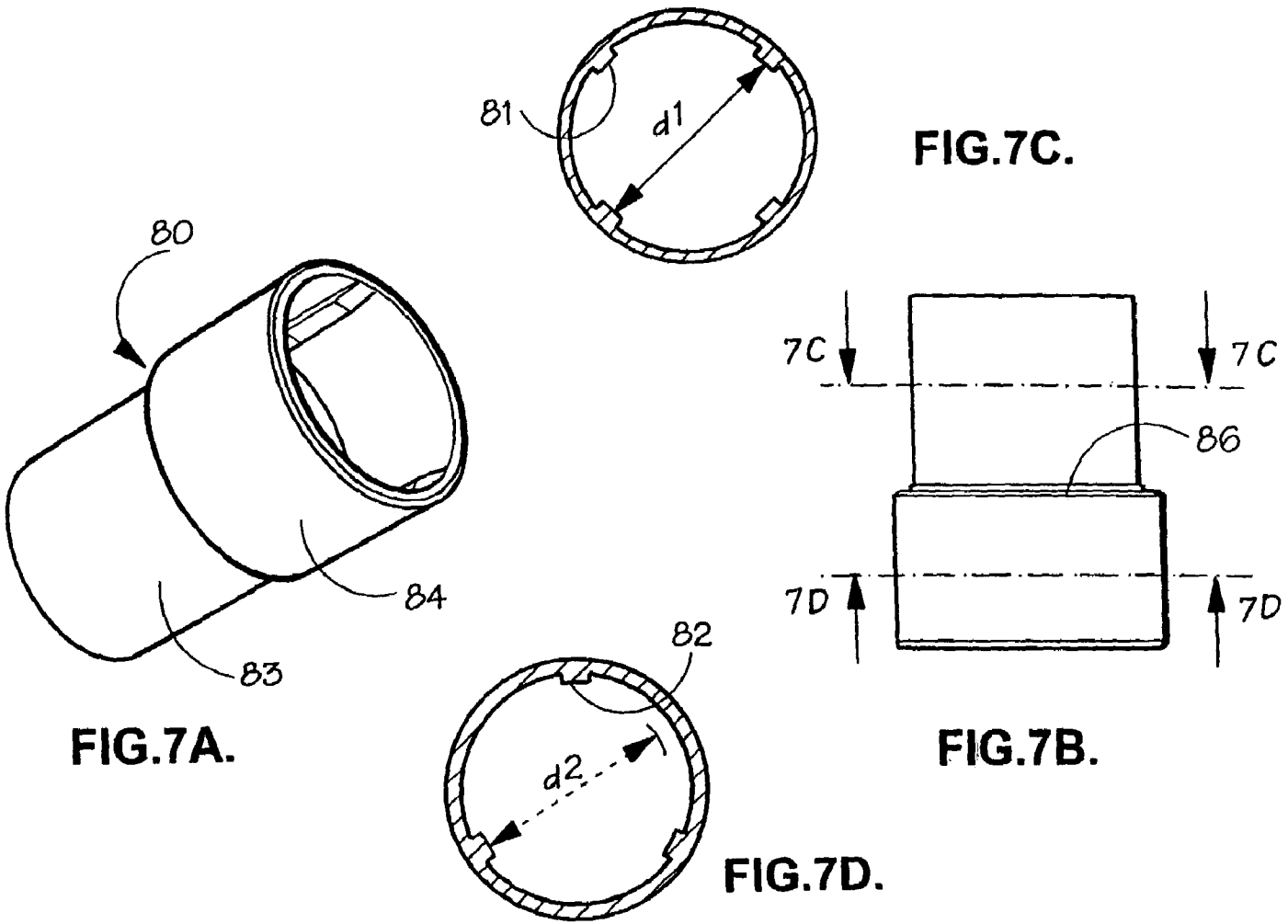
FIGS. 7A to 7D show, in more detail, the insert which is fitted inside the tool of FIGS. 6A and 6B.

FIGS. 8A and 8B show the female-to-female adapter 70 in more detail. Ribs 71, 72 are provided on the interior surface of the inlets to the adapter 70. Both inlets are of equal diameter (d2). An articulated joint 72 is provided part-way along the length of the adapter. This allows the hose connector 40 to be positioned at an angle to the wand 9 and increases comfort for the user.

Figure 9A:
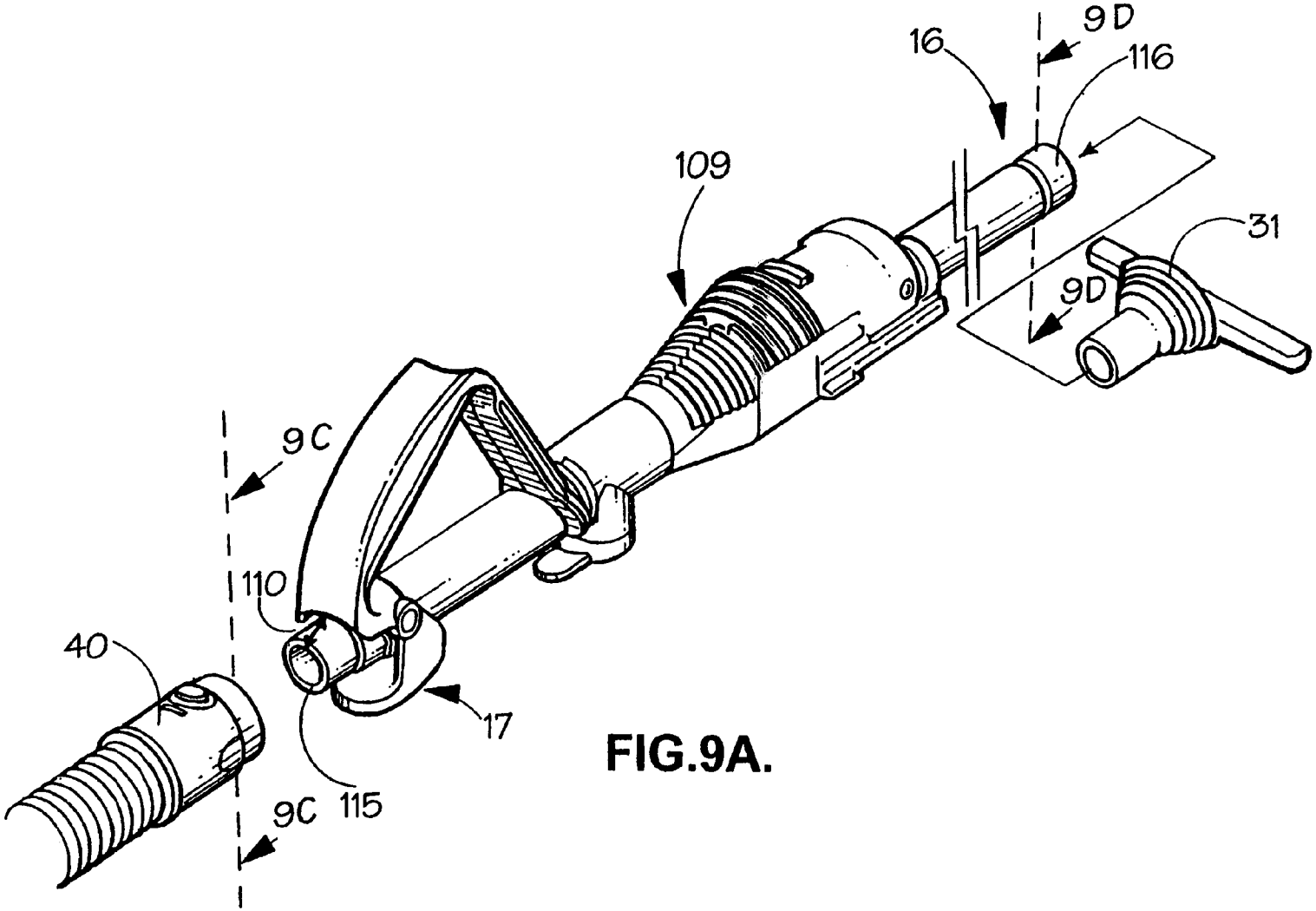

FIGS. 9A to 9C show an alternative arrangement by which the hose connector 40 and accessory tools 31 can be connected to either end of the wand 9. Modified wand 109 is the same as wand 9, except that both ends 16, 17 of the wand have plugs 115, 116 of the same shape. This allows the hose connector 40 to connect to either end of the wand without the need for the adapter 70. As in the previous embodiment, each accessory tool 31 has an outlet with portions of two different diameters. These can be provided as an insert part to an existing tool or, more preferably, are moulded integrally with the tool. To connect accessory tool 31 to hose connector 40 portion 62 of tool 31, having a diameter d2, fits around the inner sleeve 42 of the hose connector 40. To connect accessory tool 31 to either end of wand 109, portion 61 of tool 31, having a diameter d1, fits around the plug 115, 116 at the end of wand 109.

Wand 109 is modified at end 17, see region 110, to allow a greater clearance between the handle and the pipe 115 to accommodate the cuff of hose connector 40 when it is fitted at this end of the wand.

A further alternative arrangement is shown in FIG. 9D. As with the embodiment shown in FIGS. 9A–9C, wand 109 has a plug 115, 116 of diameter d1 at each end. This embodiment differs in that modified tool 31' has an outlet only of diameter d1 which allows it to fit around the plugs 115, 116 at either end of the wand 109. The hose connector 40' is modified with respect to hose connector 40 in that it has an inlet which can fit both the plugs 115, 116 at either end of the wand 109 and the tool 31'. Portion 43 of the hose connector 40' has a diameter d1, as before, but instead of the tool fitting around a sleeve on the hose connector, as previously shown in FIG. 5B, the tool 31' fits within sleeve 45 of the connector 40', having a diameter d3, and sits in portion 44 of the connector 40'. Thus, it is the hose connector 40' which has the double diameter connector. This has the advantage that the tools 31', of which there are a plurality, have a narrower inlet diameter and a shorter inlet length compared with the tools 31. Therefore the tools 31' are easier to store as they occupy less storage space.

In each of the described embodiments, the plug at each end 16, 17 of the wand 9 can be in the form of a metal pipe, such as an aluminium pipe, or a part moulded in a suitable material such as plastics.

Variations to the described embodiments will be apparent to a skilled person and are intended to fall within the scope of the claimed invention.

What is claimed is:

1. A vacuum cleaner comprising a main body having an inlet to separating apparatus, a flexible hose having one end for coupling to the inlet and another end which terminates in a connecting part, and a rigid pipe which is selectively connectable to the main body so as to provide a handle for the cleaner when the pipe is connected to the main body, or a wand when the pipe is released from the main body, the pipe having an opening at each of first and second ends and a gripping portion at the first end for allowing a user to grasp the pipe, the hose connecting part being connectable to the opening at either end of the pipe.

2. A vacuum cleaner according to claim 1 wherein the openings at the first and second ends of the pipe are of the same shape.

3. A vacuum cleaner according to claim 1 wherein the openings at the first and second ends of the pipe are of different shape, the cleaner further comprising an adapter having an inlet which is connectable to the first end of the pipe and an outlet which fits the hose connecting part.

4. A vacuum cleaner according to claim 3 wherein the adapter is articulated.

5. A vacuum cleaner according to claim 1, 2, 3 or 4 further comprising an accessory tool having an outlet which is connectable to the openings at the first and second ends of the pipe.

6. A vacuum cleaner according to claim 5 wherein the outlet of the accessory tool is also connectable to the hose connecting part.

7. A vacuum cleaner according to claim 5 wherein the accessory tool has an outlet which has sleeves of two different diameters.

8. A vacuum cleaner according to claim 7 in the form of an upright vacuum cleaner.

9. A vacuum cleaner according to claim 7 wherein the outlet of the tool comprises a stepped region, each of the sleeves forming part of the stepped region, with the sleeves decreasing in diameter in a direction inwardly from the outlet.

10. A vacuum cleaner according to claim 5 wherein the hose connecting part has an inlet which has sleeves of two different diameters.

11. A vacuum cleaner according to claim 1, 2, 3 or 4 in the form of an upright vacuum cleaner.

* * * * *